United States Patent [19]

Kalbow et al.

[11] 4,133,509

[45] Jan. 9, 1979

[54] ARTICLE MOUNTING ASSEMBLY

[76] Inventors: William H. Kalbow; Wayne R. Kalbow, both of 3318 Pearl St., Franklin Park, Ill. 60131

[21] Appl. No.: 861,646

[22] Filed: Dec. 19, 1977

[51] Int. Cl.[2] ..... A47K 1/08

[52] U.S. Cl. ..... 248/313; 248/315; 248/220.4; 248/222.4; 248/225.1

[58] Field of Search ..... 248/310, 312, 313, 311.1, 248/311.3, 315, 316 E, 316 F, 220.3, 220.4, 221.3, 222.1, 225.1, 222.2, 222.4, 302; 211/88

[56] References Cited

U.S. PATENT DOCUMENTS

| | | | |
|---|---|---|---|
| 1,159,821 | 11/1915 | Barger | 248/315 |
| 2,774,562 | 12/1956 | Henry | 248/315 |
| 3,027,036 | 3/1962 | Budreck | 248/220.3 |
| 3,424,421 | 1/1969 | Kalbow et al. | 248/312 |
| 3,908,948 | 9/1975 | Hawthorne | 248/220.4 |

FOREIGN PATENT DOCUMENTS

| | | | |
|---|---|---|---|
| 402252 | 11/1933 | United Kingdom | 248/312 |

*Primary Examiner*—Robert A. Hafer
*Attorney, Agent, or Firm*—John J. Kowalik

[57] ABSTRACT

A hanger assembly for mounting a container from the head of a nail, which nail may be driven into a wall or mounting board. The hanger comprises a hoop portion adapted to embrace the neck of a container and a tab which is attached to the free ends of the hoop portion by a pivot on one end and cam the other end, so that by turning from a horizontal to a vertical position it not only draws the free ends of the hoop together closing it about the neck of the container but also disposes a nail-admitting slot downwardly for reception of the shank of the support nail.

8 Claims, 7 Drawing Figures

ARTICLE MOUNTING ASSEMBLY

DISCUSSION OF THE INVENTION

This invention is an improvement over our prior patented invention which comprises a one piece wire member. Although we have produced such one piece structure, it nevertheless requires sophisticated equipment and a skilled tool designer to make such equipment and therefore is not readily conducive to licensing and exploitation as is the present invention which requires merely providing hooks at opposite ends of a hoop which is adapted to wrap about a container and the like parts holder and a flat disk which may be readily fabricated on a punch press and easily assembled with the hoop.

The invention comprehends a novel arrangement of pivot and cam slot openings for receiving opposite ends of the hoop, the pivot accommodating swinging of the disk from a position whereat the other end of the hoop is caused to cam to thereby draw the hoop about the container and then snap into a locking section of the cam slot.

These and other objects and advantages inherent in and encompassed by the invention will become more apparent from the specification and the drawings wherein.

Figure 1:
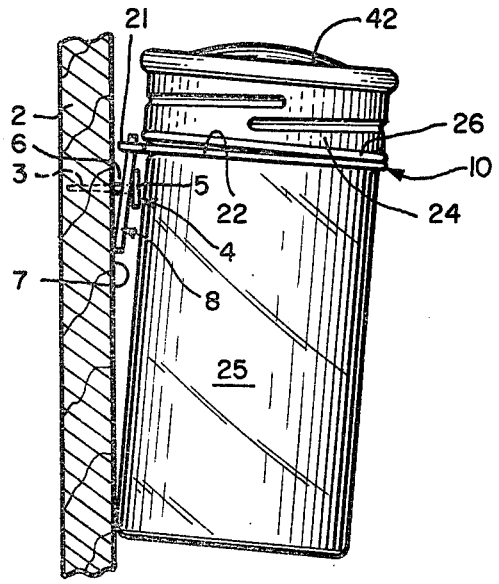
FIG. 1 is a side elevational view of a parts container associated with our novel mounting assembly.
Figure 2:
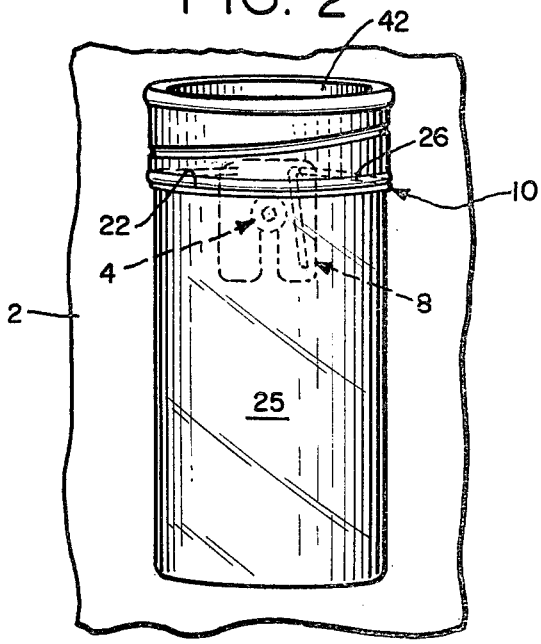
FIG. 2 is a front view thereof.
Figure 3:
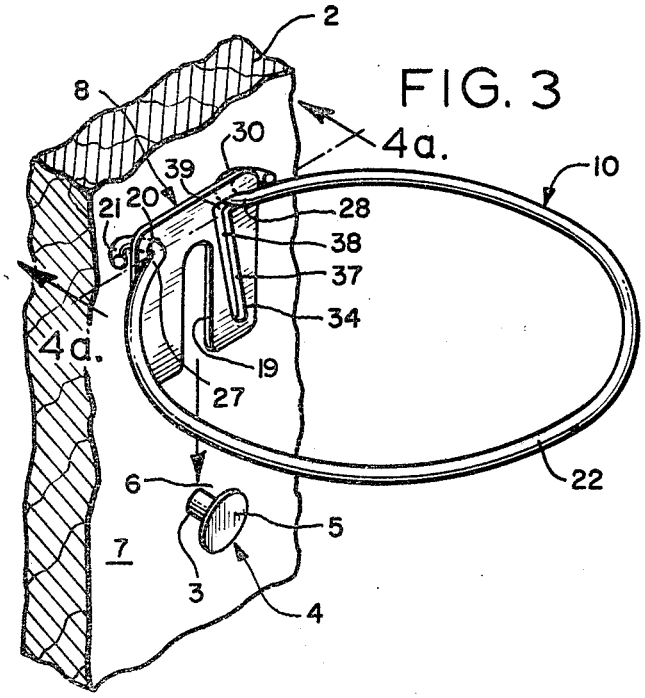
FIG. 3 is an enlarged perspective view of the mounting assembly shown in association with one form of anchor mounting.
Figure 4A:
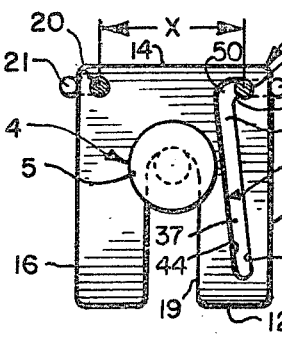
Figure 4B:
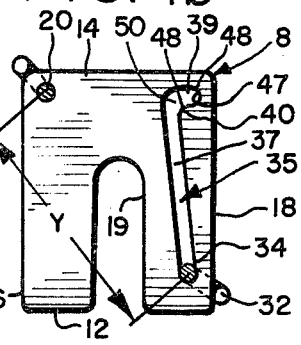

FIG. 4*a* is a view taken substantially on line 4*a*—4*a* of FIG. 3;

FIG. 4*b* is a view similar to FIG. 4*a* but illustrating the parts in unlocked position.

Figure 5:
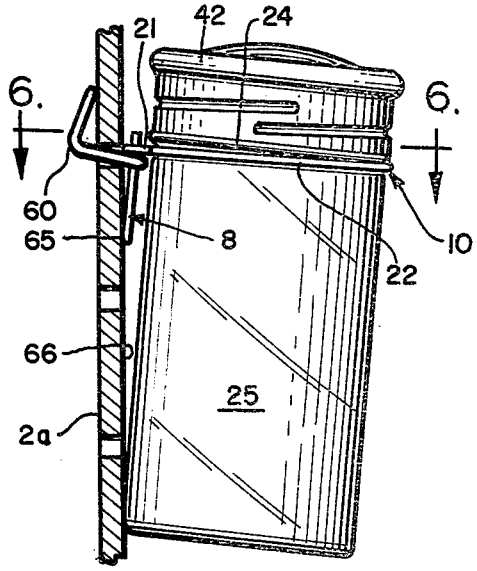
Figure 6:
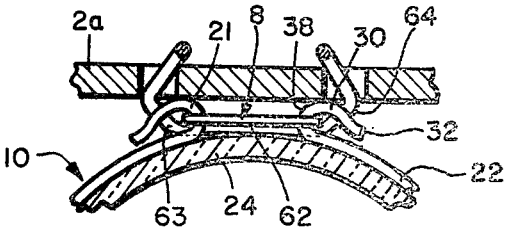

FIGS. 5 and 6 illustrate a further embodiment;

FIG. 5 being a side elevational view; and

FIG. 6 being a fragmentary enlarged horizontal cross-section taken substantially on line 6—6 of FIG. 5.

DESCRIPTION OF THE INVENTION

Describing the invention in detail, there is shown in the drawings a mounting board or wall 2 into which there has been driven the shank 3 of a nail or anchor 4. The nail has a head 5 defining a space 6 with the front surface 7 of the mounting board for admitting the tab 8 of the container mounting assembly 10.

The tab 8 comprises a rectangular, flat piece of metal strip or disk having end edges 12 and 14 and side edges 16, 18. A nail-admitting slot 19 is centered between the edges 16, 18 and extends edge 12 generally parallel to edges 16, 18 and terminates adjacent to the edge 14.

At the corner defined at the juncture of edges 14,16 there is provided a pivot hole or aperture 20 through which an eye 21 at one end of a hoop wire 22 is hooked to provide a pivot for the tab.

The hoop 22 is preferably a metal wire ring which is adapted to encircle the neck 24 of a jar or container 25 beneath a shoulder 26 on the neck so that the container is prevented from slipping off. The wire is preferably stressed to bias the free ends 27, 28 of the hoop in a direction tending to separate such ends.

It will be seen that the end of the hoop is provided with a hook 30, the free end 32 of which is adapted to be passed through the lower end 34 of an L-shaped slot 35 provided in the tab in the area between the nail slot 19 and the side edge 18 of the tab.

The slot 35 has an upright leg 37 which slopes or diverges upwardly away from the side edge 18 of the tab and at its upper end 38 joins at about a 50° – 80° angle with a horizontal leg 39 of the slot 35 about a locking corner 40.

As best seen in FIG. 4b, after the hoop is placed about the neck of the container, which may be threaded and have a cap 42 screwed thereon, the tab is positioned so that the hook end 30 is inserted into the end 34 of the slot 35. Thus the ends 27,28 of the hoop are spread out a maximum distance "y" (FIG. 4*b*), when attached to the tab. Thereafter, with the hoop in place about the neck of the bottle, the tab is manually rotated in a clockwise direction (FIG. 4*b*) and the hook 30 is caused to ride up between the cam edges 44 defining the edges of the vertical leg 37 of the slot 35. This relation of the tab is continued until the bight 38 of the hook 30 rides over the corner lobe 40 and snaps into the slot portion 39 and seats against the stop 47 defining the outer terminus of the slot portion 39. In such last described position the ends of the hoop are spaced a distance "X" (FIG. 4*a*) which provides some slack of the hoop about the container neck and in view of the round spring-wire resiliency of the hoop also permits rotation of the tab in a counter clockwise direction (FIG. 4*a*) for removal whereat the hook 30 is guided between the cam edges 48 (FIG. 4*b*) at the top and bottom of the slot portion 39, and upon entering the juncture 50 between legs 39 and 37 of the slot 35 due to the spreading outward bias provided in the hoop, the hook 30 quickly moves from the juncture to the end 34 of the slot. Thereafter, the tab is manipulated and unhooked from hook 30 and the assembly is removed from the bottle.

In FIGS. 5 and 6 anchor 60 is used of the type shown in our earlier U.S. Pat. No. 3,502,294, and is secured to an apertured wall board 2*a* and the tab 8 is inserted behind the hanger bar portion 62 between the legs 63,63 of the anchor and bears on its rear side at 65 against the forward side 66 of the board which some action prevails in the embodiment of FIGS. 1–4*b*.

Thus an improved mounting assembly is provided which is relatively easy to manufacture and assemble and disassemble with respect to the container or other similar parts holders.

Having described a preferred embodiment of the invention, it will be apparent that various modifications now can be conjured by those skilled in the art without departing from the scope of the appended claims.

We claim:

1. A mounting assembly for a container and the like parts holder, said assembly comprising a hoop portion adapted to embrace said holder and having a pair of free ends, a tab comprising a flat disk having means for mounting an associated anchor, means for pivotally connecting one of said ends of the hoop to said disk for pivotal movement relative thereto, cam means in said disk comprising a cam slot for engagement with the other end of the hoop, and means on said other end of the hoop cooperative with said cam means for locking and unlocking said hoop portion with respect to said holder attendant to predetermined pivotal movement of said disk, and said cam slot comprises a pair of angularly related portions having a juncture adjacent to the point of connection of said disk to said connecting means and thereat having a cam profile resisting movement of said other end of said hoop portion from a first portion of said cam slot to a second portion of the cam slot.

2. The invention according to claim 1 and said disk having an anchor-admitting slot extending upwardly from a lower edge thereof.

3. The invention according to claim 1 and said disk adapted to being disposed in an upright operative position and said first portion of the slot being angled from a bottom end thereto in an upward direction angled toward said connecting means and said second slot portion extending from the upper end of the first portion in a direction away from the connecting means.

4. The invention according to claim 3 and said first and second portions of the cam slot being related to each other between 50° and 80°.

5. The invention according to claim 4 and said cam slot second portion being spaced slightly below the upper edge of said disk.

6. The invention according to claim 5 and said first portion of the cam slot being disposed adjacent an edge of the disk remote from the point of pivotal connection and said pivotal connection comprising an aperture in the disk and an eye on the one end of the hoop.

7. The invention according to claim 6 and said hoop being formed of spring wire and formed and arranged to bias said hoop to spread said end portions thereof.

8. The invention according to claim 7 and said means on the other end of the hoop comprising a hook hooked through said cam slot.

* * * * *